US009708815B1

(12) United States Patent
Morris et al.

(10) Patent No.: US 9,708,815 B1
(45) Date of Patent: Jul. 18, 2017

(54) OPERABLE RAMP

(71) Applicants: Donald Morris, Littleton, CO (US); George Franco, Riverbank, CA (US)

(72) Inventors: Donald Morris, Littleton, CO (US); George Franco, Riverbank, CA (US)

(73) Assignee: LIFT-U, DIVISION OF HOGAN MFG., INC., Escalon, CA (US)

( * ) Notice: Subject to any disclaimer, the term of this patent is extended or adjusted under 35 U.S.C. 154(b) by 0 days.

(21) Appl. No.: 15/424,687

(22) Filed: Feb. 3, 2017

(51) Int. Cl.
*E04F 11/06* (2006.01)
*E04F 11/00* (2006.01)

(52) U.S. Cl.
CPC ..... *E04F 11/002* (2013.01); *E04F 2011/005* (2013.01)

(58) Field of Classification Search
CPC .... E04F 11/002; E04F 11/06; E04F 2011/005
USPC ..... 187/200; 14/71.3
See application file for complete search history.

(56) References Cited

U.S. PATENT DOCUMENTS 7,913,343 B1 * 3/2011 Cohn ..... A61G 3/061 14/71.1
8,631,529 B1 * 1/2014 Johnson ..... E04F 11/002 14/71.3
8,739,342 B1 * 6/2014 Johnson ..... E04F 11/002 14/71.3
8,782,840 B2 * 7/2014 Saucier ..... B60P 1/433 14/71.3
8,813,290 B1 * 8/2014 Morris ..... E04F 11/002 14/71.3
8,832,893 B1 * 9/2014 Morris ..... B66B 9/08 14/71.3
8,869,333 B2 * 10/2014 Johnson ..... B60P 1/433 14/71.3
8,887,337 B1 * 11/2014 Morris ..... E04F 11/002 14/71.1
8,918,939 B1 * 12/2014 Morris ..... E04F 11/002 14/71.1
8,925,131 B1 * 1/2015 Morris ..... E04F 11/002 14/71.3
8,943,631 B1 * 2/2015 Morris ..... B66B 9/08 14/71.3
9,045,908 B1 * 6/2015 Morris ..... E04F 11/002
2016/0273226 A1 * 9/2016 Belman ..... F16H 19/04

* cited by examiner

*Primary Examiner* — Gary Hartmann
(74) *Attorney, Agent, or Firm* — Christensen O'Connor Johnson; Matthew Balint

(57) ABSTRACT

An operable ramp is moveable between a stowed position and a deployed position to provide a sloped transition surface between upper and lower surfaces of an architectural setting. The operable ramp includes a housing disposed on the lower surface of the architectural setting and having a selectively adjustable height. A first ramp panel has a support element extending from a first end. The operable ramp also includes a drive assembly located within the housing. The drive assembly includes an endless loop coupled to an end of the support element to move the operable ramp between the stowed position and the deployed position. The endless loop has a linear portion located between first and second arcuate portions. The endless loop raises the end of the support element to deploy first ramp panel. The distance between the first and second arcuate portions is selectively adjustable.

19 Claims, 15 Drawing Sheets

OPERABLE RAMP

BACKGROUND

The Americans with Disabilities Act (ADA) requires the removal of physical obstacles to those who are physically challenged. The stated objective of this legislation has increased public awareness and concern over the requirements of the physically challenged. Consequentially, there has been more emphasis on providing systems that enable physically challenged people to access buildings and other architectural structures that have a step at the point of ingress or egress. Such systems can also be utilized in building interiors to provide improved access to inside architectural features, such as raised landings.

Installing a fixed ramp is a common way to provide the physically challenged with access to a building with one or more steps at the entrance, i.e., between a lower surface and an upper surface. Fixed ramps take up a large amount of space and often detract from the aesthetic qualities of the building. Fold out ramps, similar to those used in vehicles can be utilized, but deployment often requires a large area into which the ramp deploys. Other ramps simply raise or lower one end or to reciprocate between a "step" configuration and a "ramp" configuration. Such ramps, however, typically require a pit formed in the upper or lower surface to integrate the ramp with the step of the architectural setting. That is, the ramp is recessed into the architectural setting. In addition, ramps are often installed in architectural settings in which the step height varies, and ramp components and installations must be modified to suit a particular environment.

Accordingly, there is a need for a ramp that provides access to a building with a step at the entrance or within the interior, while minimizing the space required by the ramp. There is also a need for a ramp that allows for installation without requiring undue alterations of the architectural setting and that can be easily adapted for installation in different architectural environments.

SUMMARY

A first representative embodiment of a disclosed operable ramp is moveable between a stowed position and a deployed position to provide a sloped transition surface between upper and lower surfaces of an architectural setting. The operable ramp includes a housing disposed on the lower surface of the architectural setting and having a selectively adjustable height. A first ramp panel has a support element extending from a first end. The operable ramp also includes a drive assembly located within the housing. The drive assembly includes an endless loop coupled to an end of the support element to move the operable ramp between the stowed position and the deployed position. The endless loop has a linear portion located between the first and second arcuate portions. The endless loop raises the end of the support element to deploy the first ramp panel. The distance between the first and second arcuate portions is selectively adjustable.

A second representative embodiment of a disclosed operable ramp is moveable between a lowered, stowed position and a raised, deployed position. The operable ramp includes a base and a first ramp panel. A support element extends from a first end of the ramp panel. A second end of the first ramp panel is rotatable about an axis that is slidingly associated with the base. The operable ramp also has a drive assembly that includes an upper sprocket, a lower sprocket, and a chain forming an endless loop. The chain engages the upper sprocket and the lower sprocket, and the support element is rotatably coupled to the chain so that movement of the chain in a first direction raises the support element, and movement of the chain in a second direction lowers the support element. The distance between the upper sprocket and lower sprocket is selectively adjustable.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
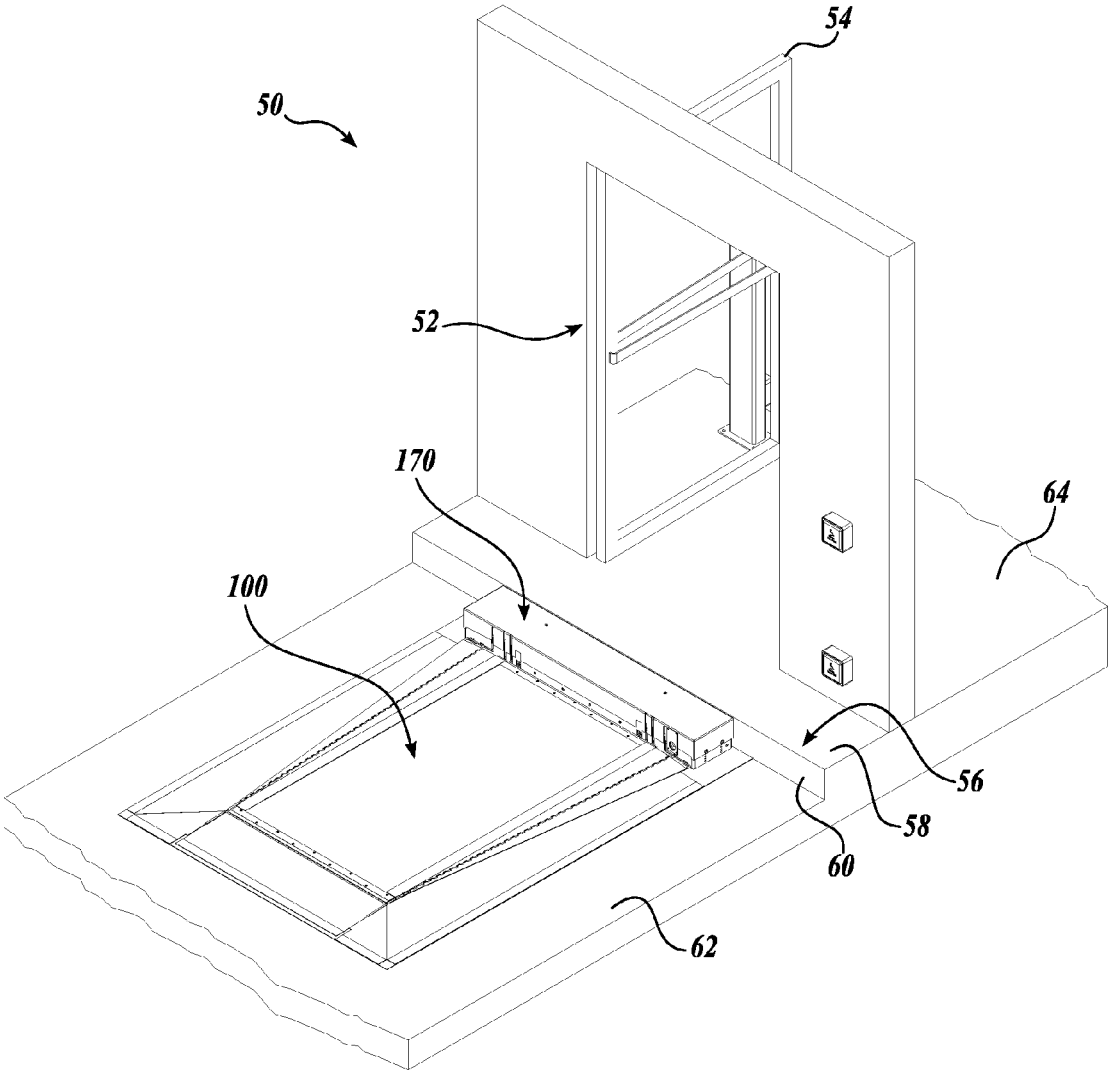
FIG. 1 shows a front isometric view of an exemplary embodiment of an operable ramp installed at an entrance to a building, wherein the operable ramp is in a stowed position.
Figure 2:
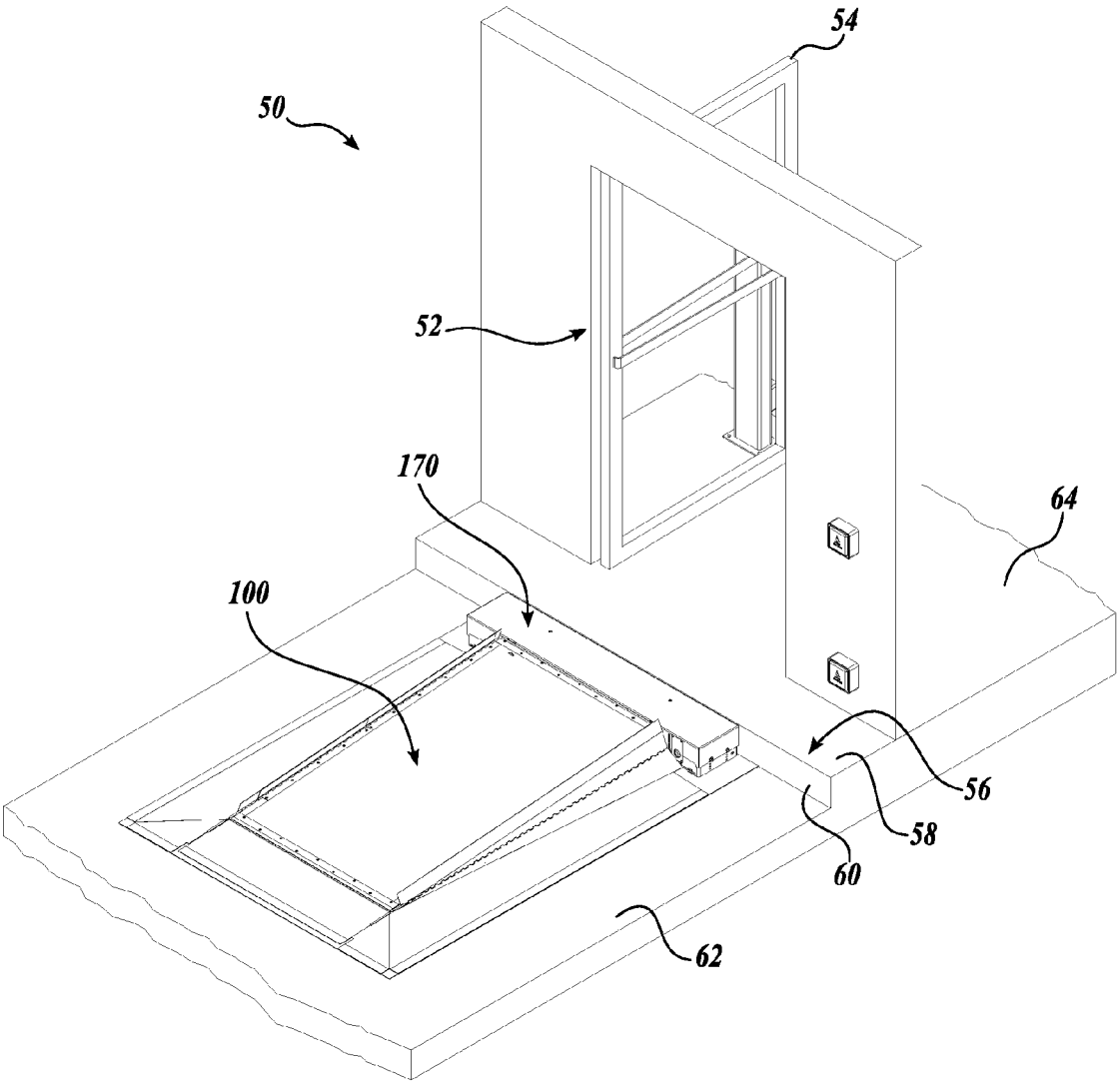
FIG. 2 shows a front isometric view of the operable ramp of FIG. 1 installed at an entrance to a building, wherein the operable ramp is in a deployed position.
Figure 3:
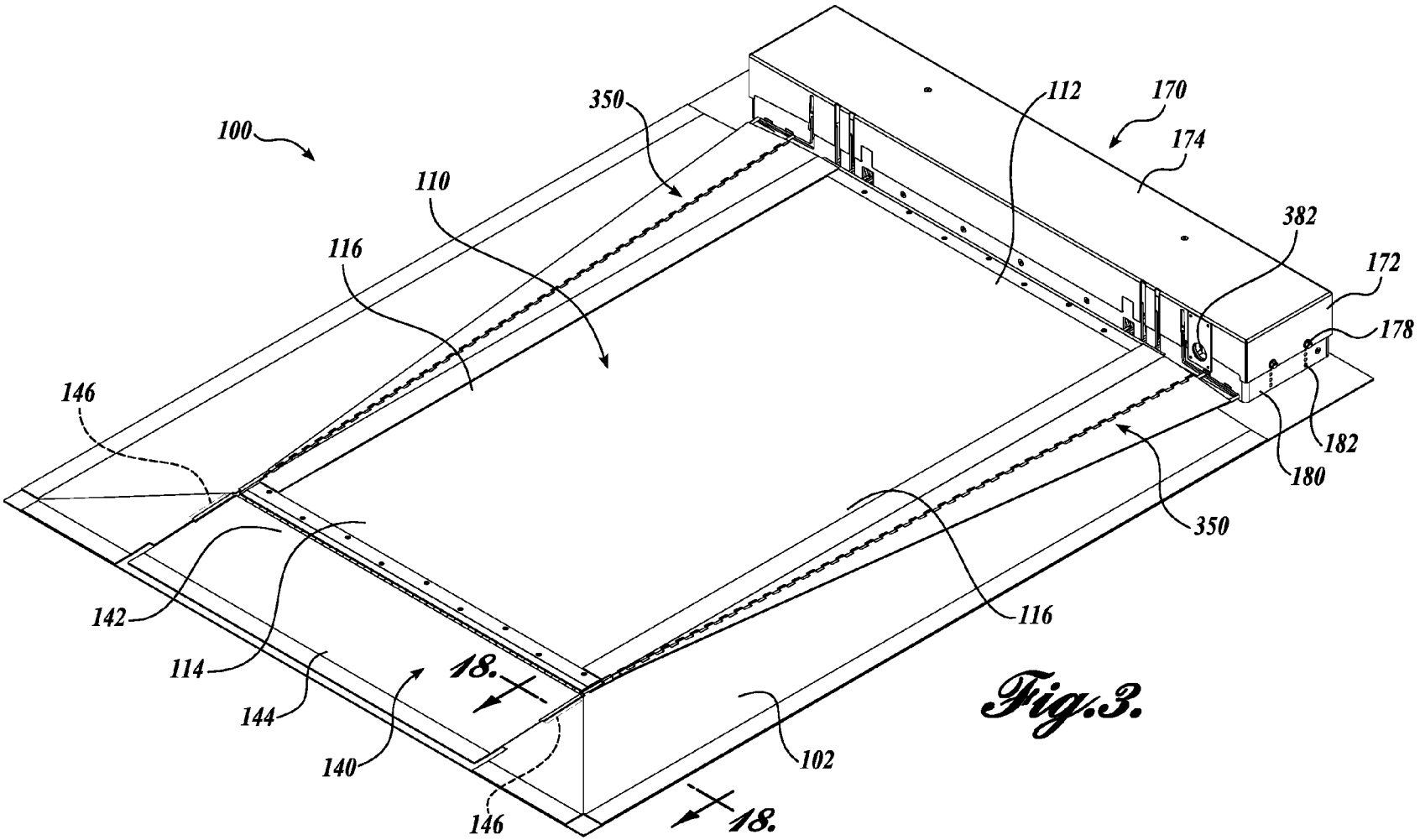
FIG. 3 shows a front isometric view of the operable ramp of FIG. 1 in the stowed position.
Figure 4:
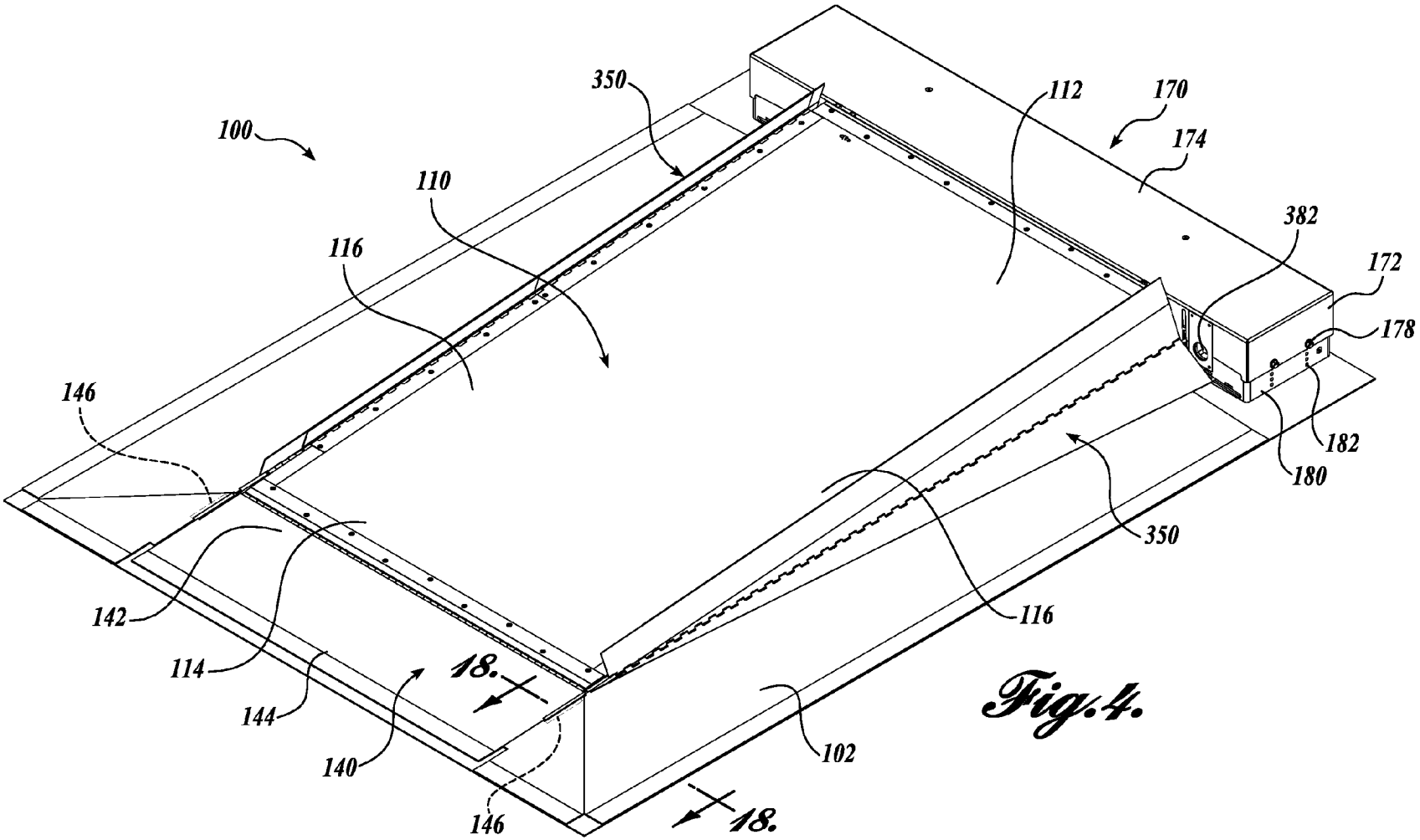
FIG. 4 shows a front isometric view of the operable ramp of FIG. 3 in the deployed position.

FIGS. 1-4 show an exemplary embodiment of an operable ramp 100. More specifically, FIGS. 1 and 2 show the operable ramp 100 in a stowed position and a deployed position, respectively, while installed at the entrance 52 of a building 50. FIGS. 3 and 4 show the same embodiment of an operable ramp 100 stowed and deployed, respectively, in isolation, i.e., not installed. Referring to FIGS. 1 and 2, the entrance 52 includes a door 54 with a step 56 positioned outside of the door. The step includes a tread portion 58 and a riser portion 60. The tread portion 58 of the step 56 is level with the floor of the building 50 so that a person walking into the building uses the step to step up from a lower first surface 62 outside the building to a higher second surface 64 inside the building. It will be appreciated that the illustrated installation of the operable ramp 100 is exemplary only and should not be considered limiting. In this regard, the operable ramp 100 can be installed in any number of architectural settings having a step that would present an obstacle for a disabled person.

The operable ramp 100 includes a housing 170 that contains a drive assembly 200 located proximate to the riser portion 60. As shown in FIGS. 1 and 2, the housing 170 is generally rectangular and is sized and configured to be positioned against the riser portion 60 of the step 56 so that an upper surface 174 of the housing 170 is generally coplanar with the second surface 64. As a result, the housing 170 acts as an extension of the second surface 64, and thus, the step 56.

First Ramp Panel

Figure 5:
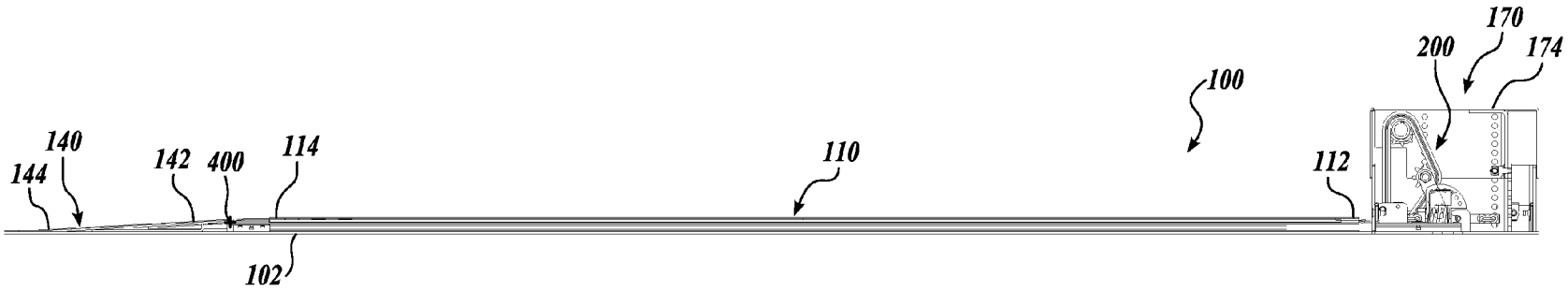
FIG. 5 shows a cutaway side view of the operable ramp of FIG. 3 in the stowed position.
Figure 6:
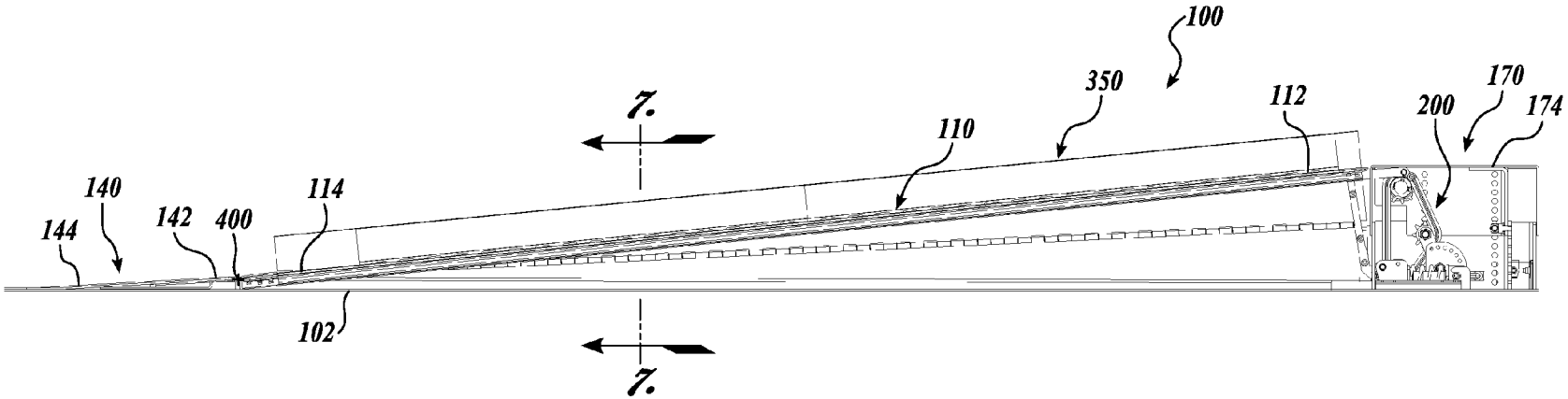
FIG. 6 shows a cutaway side view of the operable ramp of FIG. 3 in the deployed position.
Figure 7:
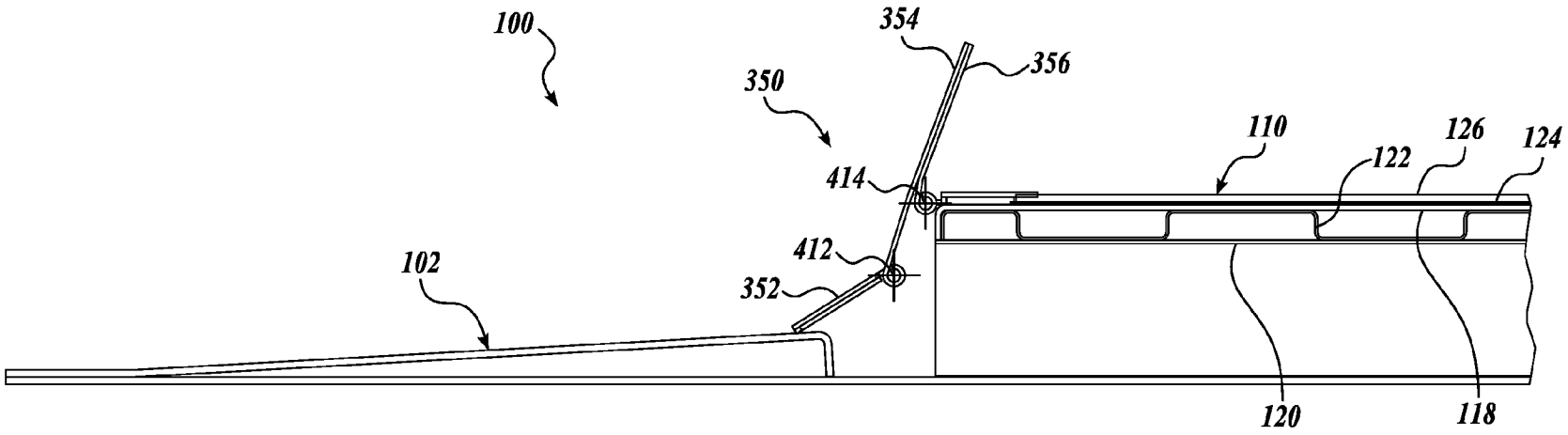
FIG. 7 shows a partial cutaway rear end view of the operable ramp of FIG. 6 in the deployed position.

Referring to FIGS. 5-7, a first ramp panel 110 has a first end 112 coupled to the drive assembly 200 that selectively reciprocates the first end between a lowered (stowed) position and a raised (deployed) position. The first ramp panel 110 is constructed from well-known materials to have suitable strength and durability. As best shown in FIG. 7, the first ramp panel 110 of the disclosed embodiment includes a corrugated sheet metal layer 122 disposed between an upper plate 118 and a lower plate 120. A suitable tread surface 126 is disposed on top of the upper plate 118 to provide a replaceable slip-resistant surface. The layers of the panel are secured together using welds, adhesive, mechanical fasteners, or any other suitable methods or combinations of suitable methods.

Positioned between the tread surface 126 and the upper plate 118 is a thin membrane pressure sensor 124 configured to sense the presence of a passenger on the operable ramp 100. The sensor 124 is operably coupled to a controller 232, which prevents operation of the operable ramp 100 when the sensor 124 sends a signal to the controller indicating that a passenger is present on the operable ramp. It will be appreciated that other sensor types and configurations may be utilized, and that the location of such sensors is not limited to the operable ramp 100, itself. In one contemplated embodiment, an optical sensor is positioned above or proximate to the operable ramp 100. These and other configurations to sense the presence of a passenger on the operable ramp are contemplated and should be considered within the scope of the present disclosure.

Second Ramp Panel

Figure 8:
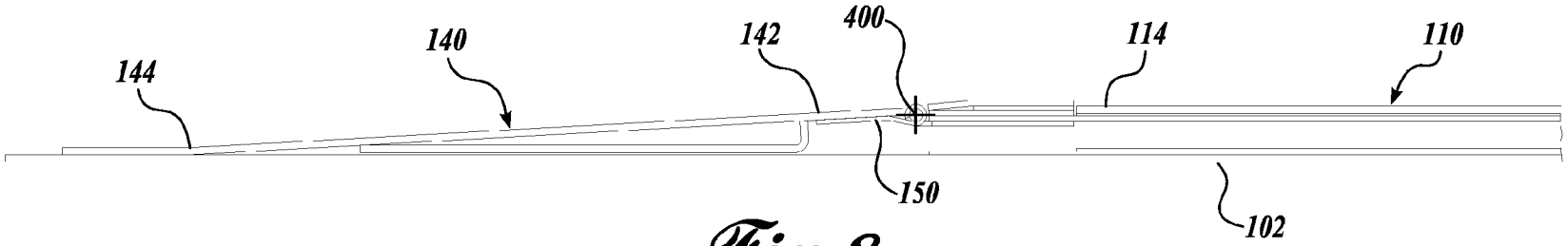
FIG. 8 shows a partial cutaway side view of a second end of the operable ramp of FIG. 3 with the operable ramp in the stowed position.
Figure 9:
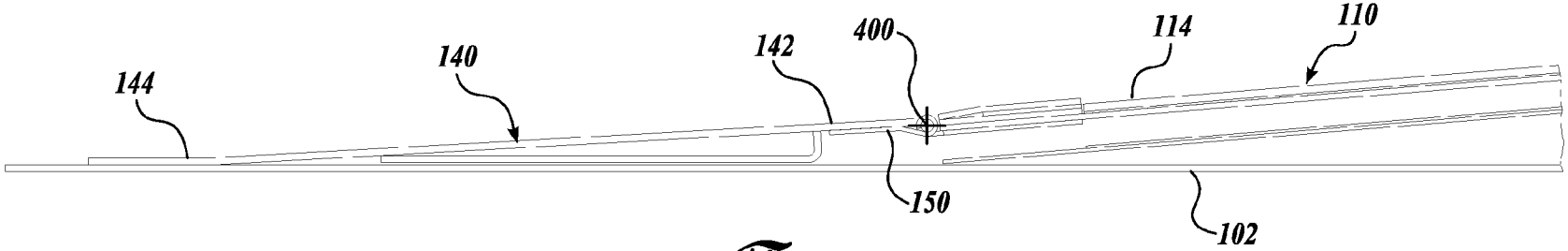
FIG. 9 shows a partial cutaway side view of the second end of the operable ramp of FIG. 3 with the operable ramp in the deployed position.
Figure 18:
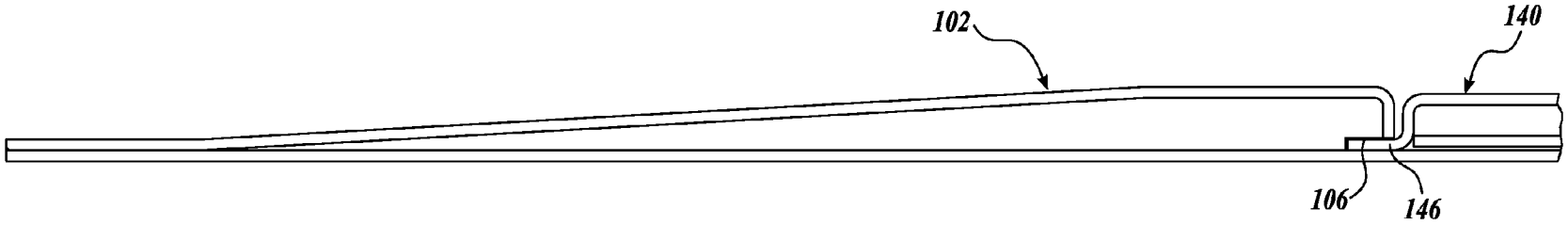
FIG. 18 shows a partial cutaway rear end view of the operable ramp of FIG. 3 in the deployed position.

Referring now to FIGS. 8 and 9, a second end 114 of the first ramp panel 110 is rotatably coupled to a first end 142 of a second ramp panel 140 by a hinge 150 about axis 400. The second ramp panel 140 is slidably coupled to the base 102, preferably in a manner that prevents rotation of the second ramp panel relative to the base 102. As shown in FIGS. 3, 4, and 18, the illustrated embodiment of the second ramp panel 140 includes tabs 146 that extend laterally into slots 106 formed in the base. As will be described later, the second end 114 of the first ramp panel 110 is supported by the hinged connection to the second ramp panel 140 when the operable ramp 100 is in the deployed position. The slotted engagement of the second ramp panel 140 with the base 102 allows the second ramp panel to slide relative to the base, while preventing the weight of the first ramp ramp panel 110 from rotating the second ramp panel to drive down the hinged connection between the panels, which would raise the second end 144 of the second ramp panel.

Referring back to FIGS. 8 and 9, the second ramp panel 140 has a sloped upper surface. In this regard, the first end 142 of the second ramp panel is higher than a second end 144 of the second ramp panel, so that the upper surface provides a sloped transition from the first ramp panel 110 to the base 102 and/or the first surface 62.

In the illustrated embodiment, the second ramp panel 140 is a generally rectangular panel formed of known materials to have suitable strength and durability such that the panel can withstand user traffic in both the stowed and deployed positions. In one exemplary embodiment, the second ramp panel 140 is formed from one or more pieces of sheet metal (such as aluminum or steel), with a plurality of stiffeners attached to the bottom of the panel to provide additional stiffness and to maintain an upper surface of the panel at a predetermined angle. A texture is preferably formed integrally with or applied to the upper surface of the second ramp panel 140 to provide improved traction.

Housing

Figure 10:
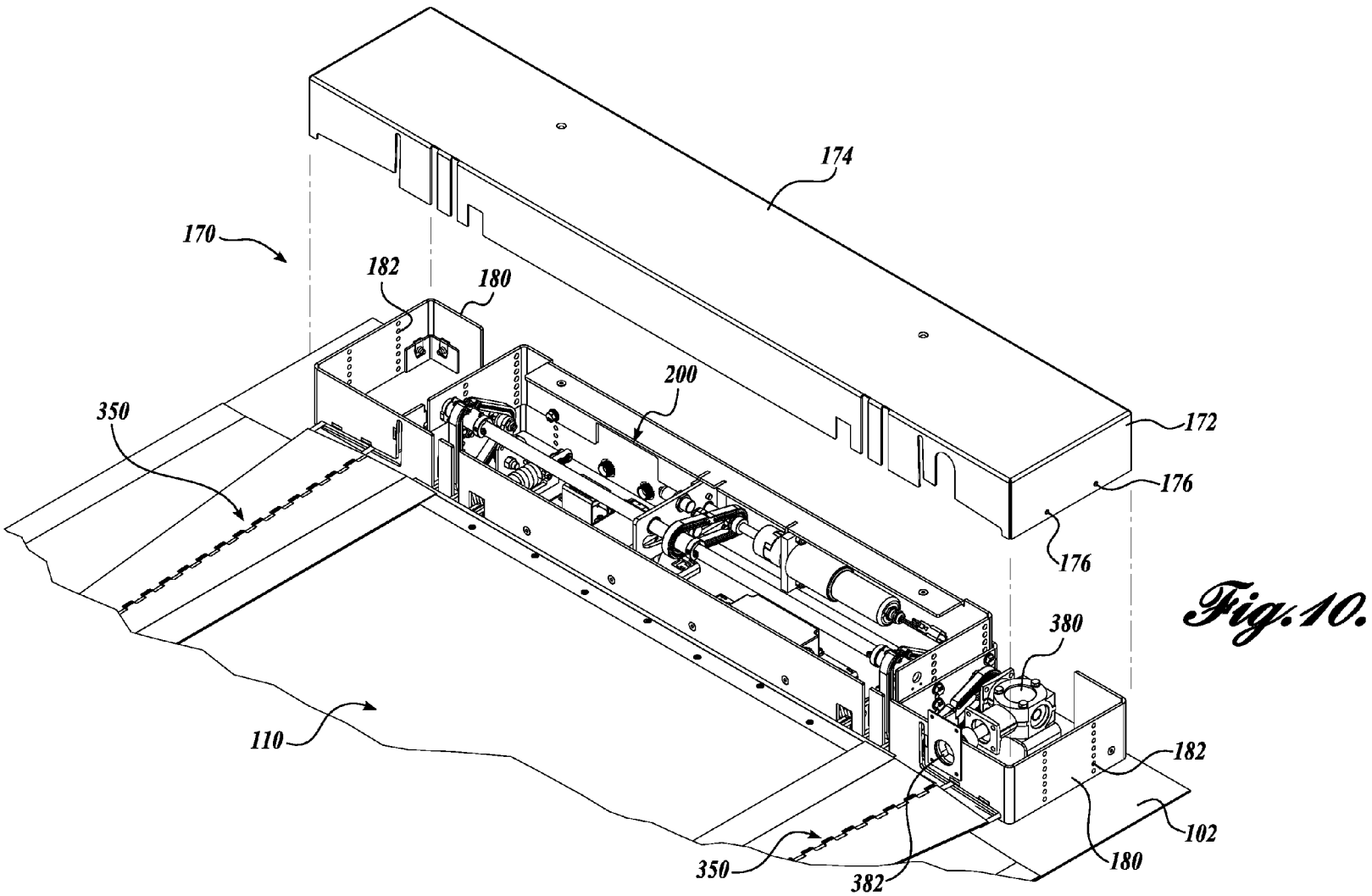
FIG. 10 shows an exploded front isometric view of a drive assembly housing positioned at a first end of the operable ramp of FIG. 3, wherein a housing closeout is removed from the housing.
Figure 11:
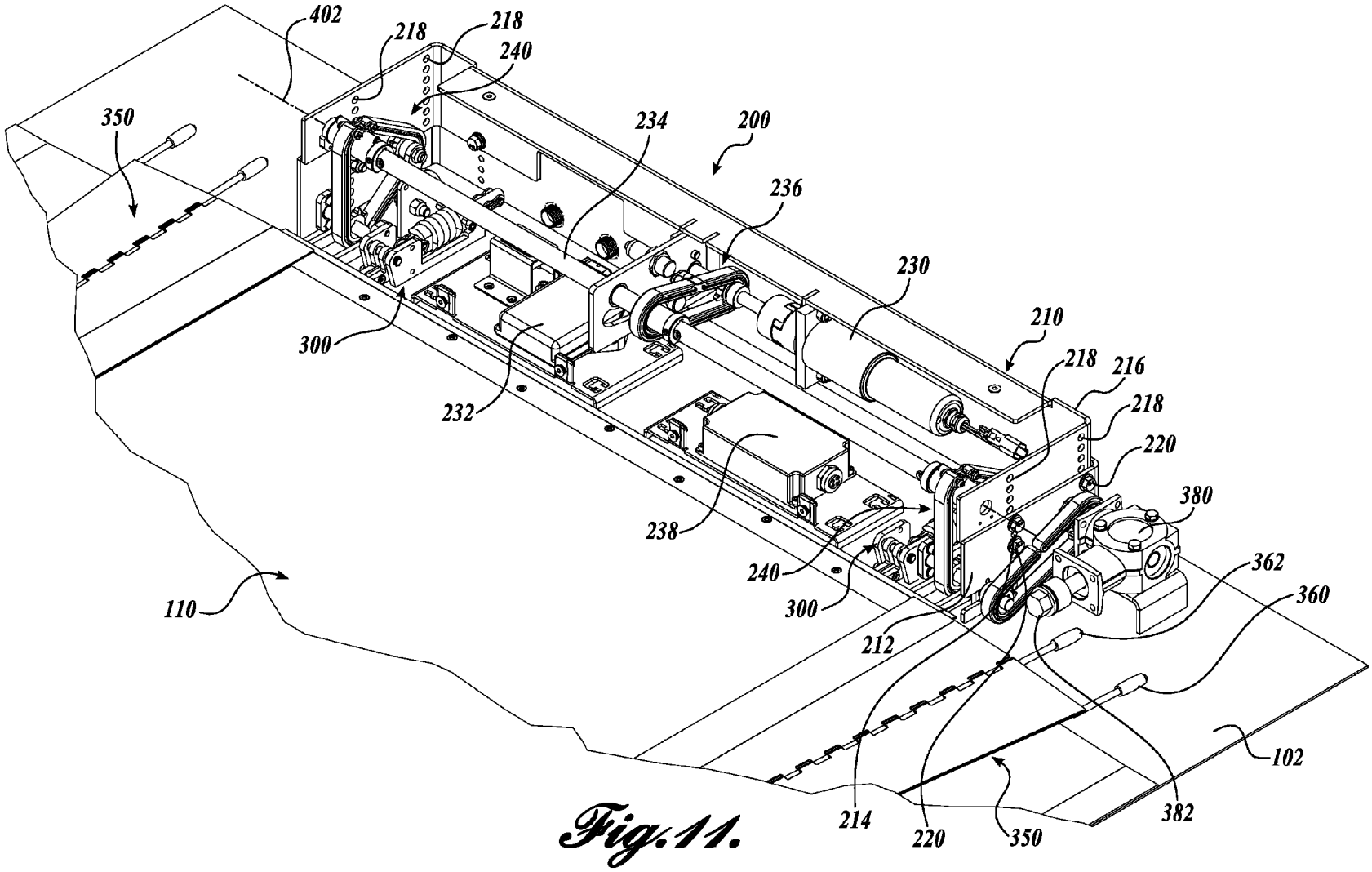
FIG. 11 shows a front isometric view of a drive assembly of the operable ramp of FIG. 3 with the drive assembly housing removed.

As shown in FIGS. 10 and 11, the housing 170, which contains the drive assembly 200, includes a base 180 that forms at least part of a rectangular structure with vertical walls. A plurality of holes 182 are formed in the walls of the base 180. A rectangular housing closeout 172 is sized and configured to at least partially receive and also be supported by the base 180. The closeout 172 includes holes 176 disposed therein, wherein each hole 176 in the closeout corresponds to more than one of the holes 182 in the base 180. In this regard, the holes in the base 180 are arranged in vertical groups around the base so that the height of the closeout 172 and, therefore, the housing 170 can be selected by aligning the holes 176 in the closeout 172 with different groups of holes 182 in the base 180 and then securing the closeout to the base with fasteners 178 that extend through corresponding holes in the base and closeout. As a result, the height of the housing 170 is selectively adjustable to correspond to the height of the step 56 in the architectural setting in which the operable ramp 100 is installed.

In one contemplated embodiment, the height of the step is adjustable between 4 inches and 7 inches. In another contemplated embodiment, the height of the housing is adjustable in ½ inch increments. It will be appreciated that the range of closeout heights can vary, as well as the increments in which the heights can be varied. In addition, different configurations to adjustably couple the closeout to the base are contemplated. These and other embodiments of a housing that (1) provide an enclosure for the drive assembly and (2) have an upper surface with a selectively adjustable height are contemplated and should be considered within the scope of the present disclosure.

Drive Assembly

Still referring to FIGS. 10 and 11, the drive assembly 200 includes an adjustable drive support 210 to which various components of the drive assembly are mounted. The drive support 210 includes a lower support 212 that is fixedly mounted relative to the base 102. In the illustrated embodiment, the lower support 212 is formed from sheet metal positioned to provide mounting locations for certain components of the drive assembly 200. A plurality of apertures 214 are formed in the lower support 212.

The drive support 210 also includes an upper support 216 that is adjustably mountable to the lower support 212. Similar to the lower support 212, the disclosed embodiment of the upper support 216 is formed from sheet metal with a plurality of apertures 218 formed therethrough. The upper support 216 and apertures 218 are sized and configured so that the upper support can be positioned at different locations relative to the lower support 212 and secured in place using fasteners 220 extending through corresponding apertures 214 and 218 in the upper and lower supports. In this way, an installer can selectively adjust the position of the upper support 216 relative to the lower support 212. Like the lower support 212, the upper support 216 also provides locations to which certain components of the drive assembly 200 can be mounted. As a result, an installer can selectively adjust the position of certain drive assembly 200 components relative to each other by adjusting the position of the upper support 216 relative to the lower support 212.

It will be appreciated that the illustrated drive support 210 is exemplary only and should not be considered limiting. In this regards, various alternate embodiments that allow for the selective adjustment of the position of various drive assembly 200 components relative to each other are contemplated, and such alternate embodiments should be considered within the scope of the present embodiment.

As best shown in FIG. 11, the drive assembly 200 includes a motor 230 mounted to the upper support 216 and is operably coupled to a controller 232, which controls the operation of the motor according to various operator inputs and operating conditions. A power supply 240 provides power to drive the motor. A drive shaft 234 is rotatably mounted about an axis 402 to the upper support 216. The motor 230 is coupled to the drive shaft 234 by a known transmission 236 so that the motor selectively rotates the drive shaft about axis 402. The drive shaft 234 extends across the width of the operable ramp 100 and is coupled at each end to a chain assembly 240. In the illustrated embodiment, the chain assemblies 240 are similar. Accordingly, one chain assembly 240 will be described with the understanding that the other chain assembly is likewise configured. The drive assembly also includes one or more proximity sensors (not shown) operatively connected to the controller 232 to identify when the operable ramp is in a stowed position and a deployed position.

Figure 12:
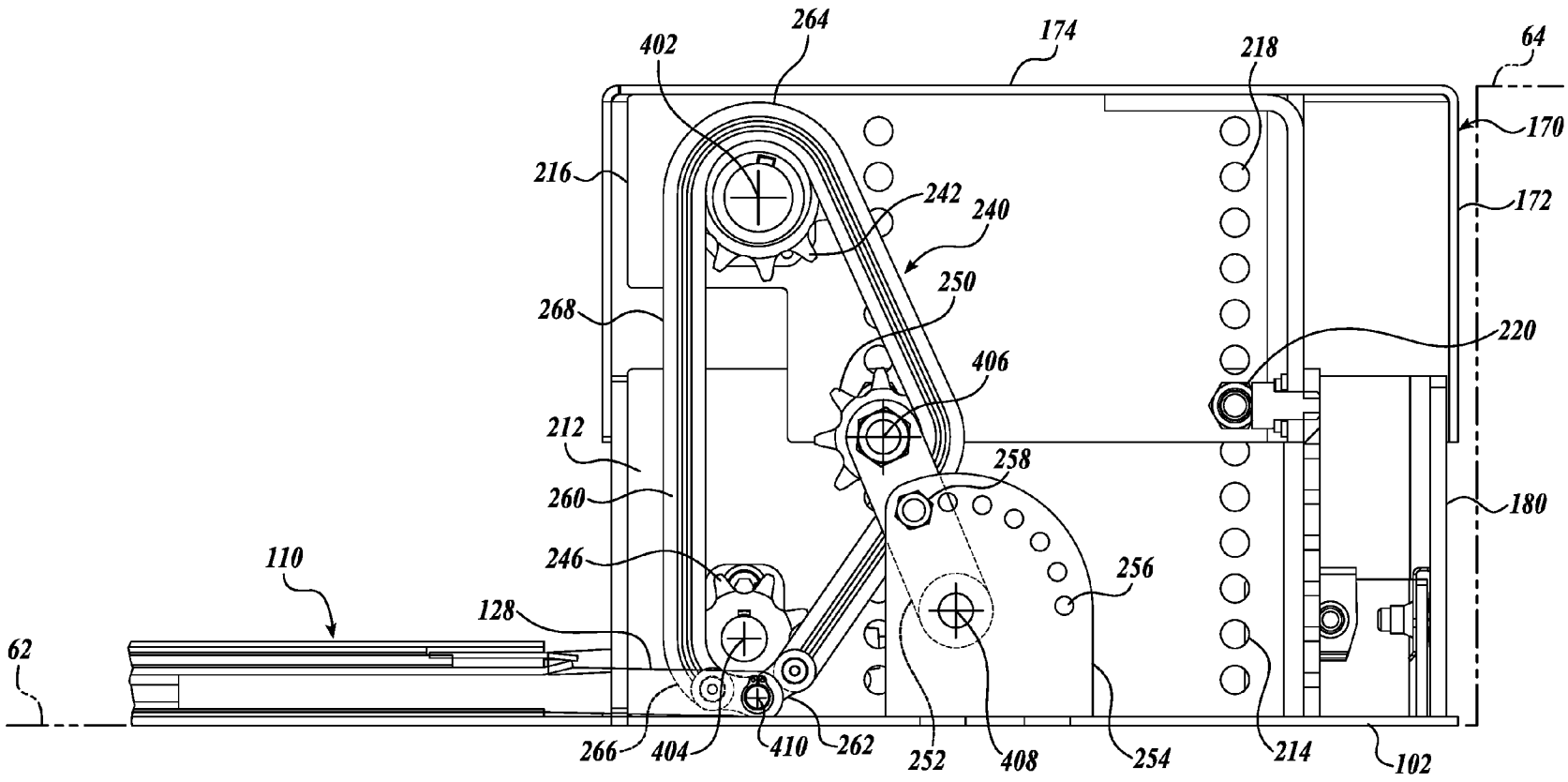
FIG. 12 shows a partial cutaway side view of the drive assembly of FIG. 11 with the operable ramp in the stowed position and the operable ramp configured for a first step height.
Figure 13:
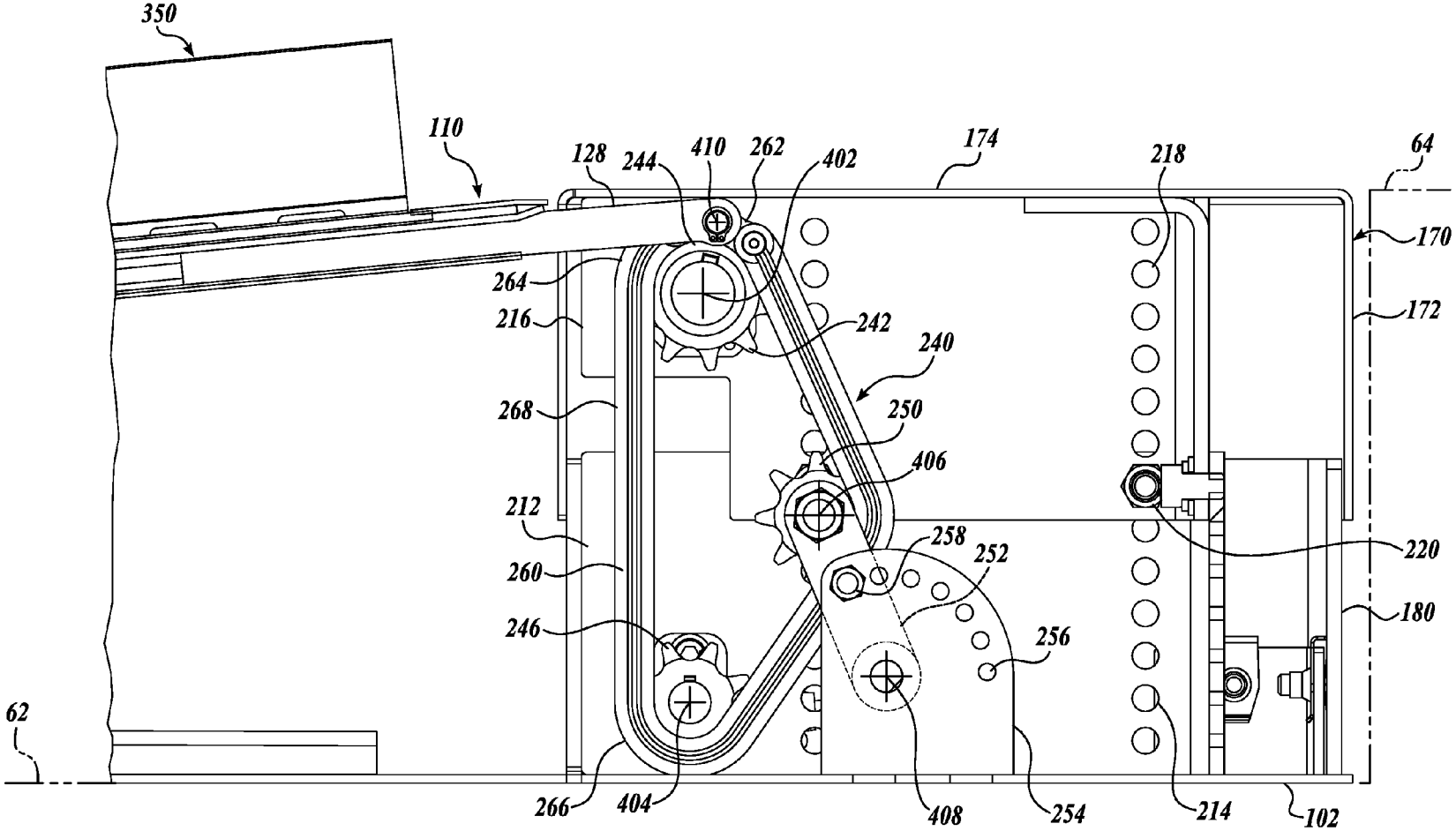
FIG. 13 shows a partial cutaway side view of the drive assembly of FIG. 12 with the operable ramp in the deployed position and the operable ramp configured for the first step height.

Referring now to FIGS. 12 and 13, a side view of one chain assembly 240 is shown with the operable ramp in the stowed position (FIG. 12) and the deployed position (FIG. 13). The chain assembly 240 includes an upper sprocket 242 and a lower sprocket 246. The upper sprocket 242 is coupled to the drive shaft 234 so that rotation of the drive shaft rotates the upper sprocket about the drive shaft axis 402. The lower sprocket 246 is coupled to the lower support 212 or some other fixed structure to be rotatable about an axis 404 that is parallel to the drive shaft axis 402.

A chain 260 forms an endless loop that engages the upper and lower sprockets 242 and 246. As previously described, the position of the upper support 216, to which the axis 402 of the upper sprocket 242 is fixedly positioned, is selectively adjustable relative to the lower support 212, to which the axis 404 of the lower sprocket 246 is fixedly positioned. As a result, adjustment of the upper support 216 relative to the lower support 212 changes the distance between the upper sprocket 242 and the lower sprocket 246. To account for this change, a selectively positionable idler sprocket 250 engages the chain 260. The idler sprocket 250 allows the path of the chain 260 to be modified so that the length of the chain path can be maintained when the distance between the upper sprocket 242 and the lower sprocket 246 changes. This in turn prevents the chain 260 from becoming too taut or too slack.

The idler sprocket 250 is rotatably mounted to an elongate support arm 252 about an axis 406, which is parallel to the upper sprocket axis 402 and the lower sprocket axis 404. The support arm 252 is rotatably mounted to a support bracket 254 about axis 408. The bracket is fixedly positioned relative to the lower support 212 and includes a plurality of holes 256 positioned circumferentially about axis 408. The position of the idler sprocket 250 is adjusted by rotating the support arm 252 about axis 408 until the idler sprocket is in a desired position and then securing the support arm relative to the support bracket 254. In the illustrated embodiment, a the support arm 252 is secured to the support bracket 254 using a fastener 258 that extends through a hole (not shown) in the support arm and one of the corresponding holes 256 in the support bracket.

The disclosed support bracket 254 is fixedly positioned relative to the base 102 and the lower support 212; however, alternate embodiments are contemplated in which the support bracket is coupled to the upper support 216 or any other suitable structure. It is also contemplated that other idler sprocket configurations can be utilized. In one alternate embodiment the idler sprocket is mounted to a support that is biased by a spring element to maintain a desired tension on the chain. These and other configurations to maintain a desired tension for a range of upper and lower sprocket positions are contemplated and such configurations should be considered within the scope of the present disclosure.

Figure 14:
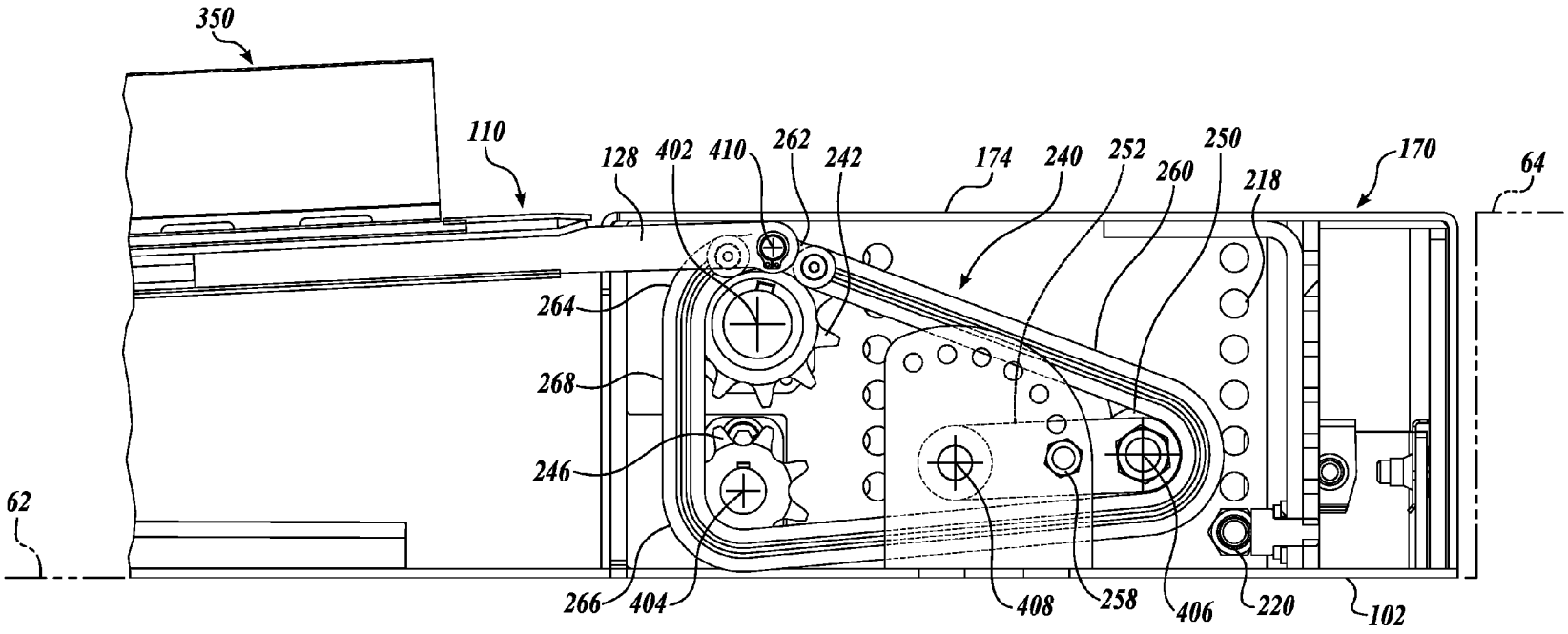
FIG. 14 shows a partial cutaway side view of the drive assembly of FIG. 12 with the operable ramp in the deployed position and the operable ramp configured for a second step height.

FIGS. 12 and 13 show the operable ramp 100 in stowed and deployed positions, relatively, when the operable ramp is configured for installation in conjunction with a step having a taller riser, for example, a 7 inch riser. FIG. 14 shows the operable ramp 100 configured for installation in conjunction with a shorter step, for example, a step with a 4 inch riser. To accommodate the shorter step, the upper support 216 of the drive support 210 is mounted to the lower support 212 such that the upper sprocket 242 is closer to the lower sprocket 246. This in turn reduces the vertical travel of the coupler 262 and, therefore, the first end 112 of the first ramp panel 110. The idler sprocket 250 is repositioned to account for undesired slack in the chain that would result from the reduced distance between the upper and lower sprockets 242 and 246. The closeout 172 is mounted to the housing base 180 so that the upper surface 174 of the closeout is generally level with the second surface 64 of the architectural setting. By providing adjustability in the drive support 210 and housing 170, the present operable ramp provides a housing that can be matched to the height of different steps and an inclined ramp surface that can be configured to account for the different step heights.

Referring back to FIGS. 12 and 13, the first ramp panel 110 is coupled to the drive assembly 200 by a plurality of elongate support elements 128 fixedly secured to the first end 112 of the panel. More specifically, support elements 128 extend from the first end 112 of the first ramp panel 110 and are generally parallel with the upper surface of the first ramp panel. Each support element 128 is rotatably coupled to one of the chain assemblies 240 about axis 410. In the illustrated embodiment of FIGS. 12 and 13, the support element 128 is rotatably coupled to the chain 260 by a coupler 262 that forms part of the chain. As the chain moves along the path of its endless loop, the end of the support element 128 move with the chain to reciprocate the first ramp panel 110 between the stowed position of FIG. 12 and the deployed position of FIG. 13.

In the illustrated embodiment, the path of the chain 260 includes two arcuate portions 264 and 266 where the chain engages the upper sprocket 242 and lower sprocket 246, respectively. The chain also includes a linear portion 268 extending between the arcuate portions 264 and 266.

In other contemplated configurations, a rotatable drive arm or other suitable linkage is used in place of the chain assembly 240 to move the coupler 262 along a predetermined path. Further, the path of the coupler 262 can vary. In one contemplated embodiment, such as when a rotating drive arm is utilized, the coupler 262 follows an arcuate path through the entire deployment motion. These and other configurations are contemplated and should be considered within the scope of the present disclosure.

Counterbalance

In order to reduce the size of the actuating force required from the motor 230 and to reduce wear and tear on the drive assembly 200 components in general, the operable ramp 100 includes a counterbalance 300 disposed within the housing 170 and extending under the first ramp panel 110. The counterbalance 300 applies an upward force $F_C$ to the bottom of the first ramp panel 110 to counteract at least a portion of the weight of the first ramp panel. In doing so, the counterbalance 300 allows for the use of a smaller, more compact motor 230 and prolongs the life of the drive assembly 200.

Figure 15:
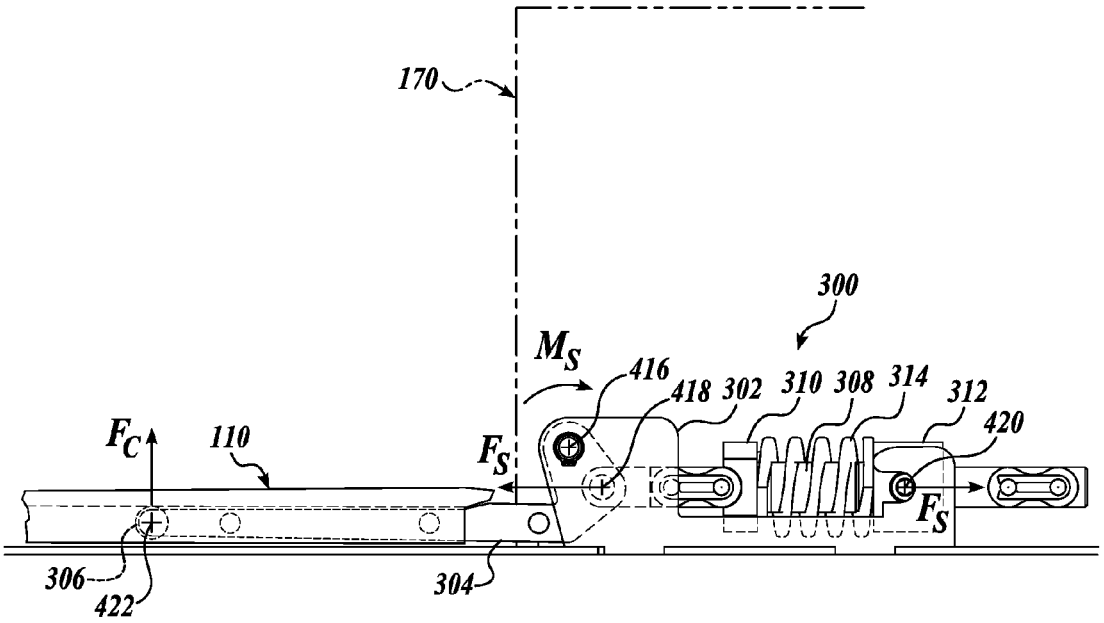
FIG. 15 shows a side view of a counterbalance of the operable ramp of FIG. 3 with the operable ramp in the stowed position.
Figure 16:
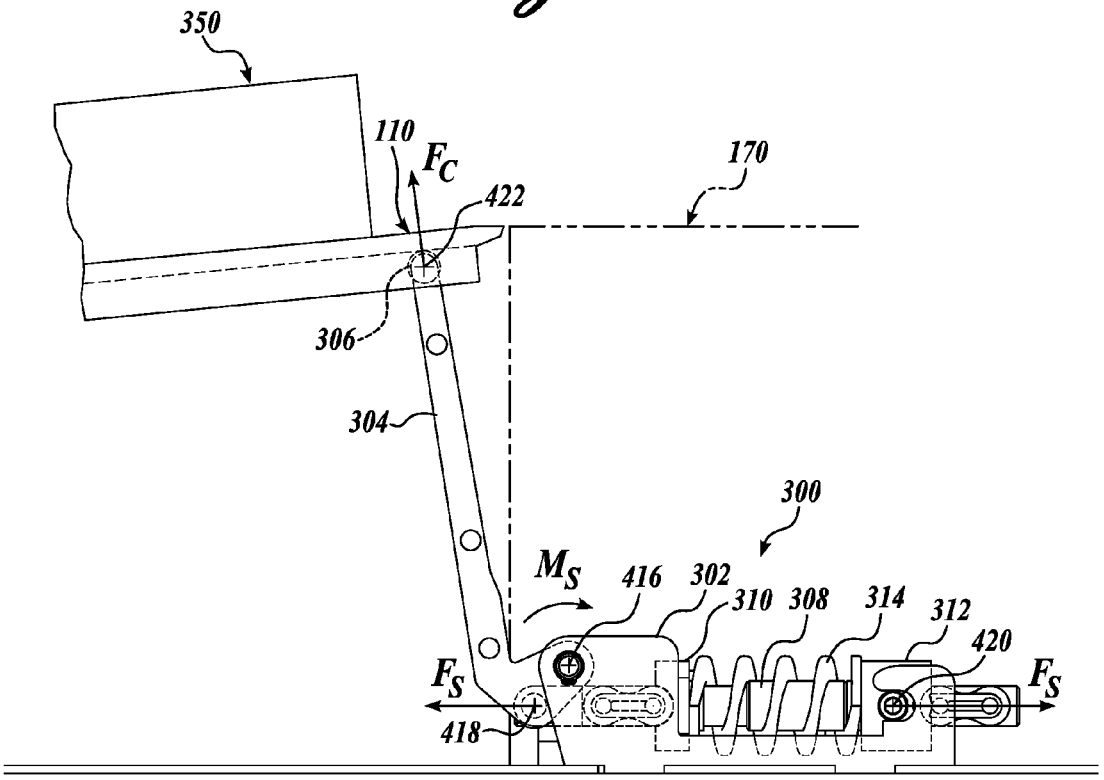
FIG. 16 shows a side view of the counterbalance of FIG. 15 with the operable ramp in the deployed position

As shown in FIGS. 15 and 16, the counterbalance 300 includes a mounting fitting 302 coupled to the frame 102 or other suitable structure within the housing 170. A link 304 is rotatably coupled at one end to the mounting fitting 302 about an axis 416. A second end of the link 304 has a roller bearing 306 rotatably mounted to the link about an axis 422 or another suitable bearing element or surface disposed thereon. The roller bearing 306 rollingly or slidingly engages a lower surface of the first ramp panel 110. In the illustrated embodiment, a slot is formed in the lower plate 120 of the first ramp panel 110 so that the roller bearing 306 engages the corrugated layer 122. In this manner, when the operable ramp 100 is in the stowed position, the link 304 extends into a channel in the corrugated layer 122, thereby reducing the height of the ramp portion of the operable ramp 110 in the stowed position. In contemplated alternate embodiments, a static bearing surface is disposed at the end of the link 304 and slidingly engages the first ramp panel 110.

A biasing element 310 in the form of a cylindrical fitting is fixedly coupled to the rod 308 proximate to the link 304. A spring fitting 312 is slidably coupled to a rod 308 opposite the biasing element 310. The spring fitting 312 is rotatably coupled to the mounting fitting 302 about axis 420. The rod 308 is rotatably coupled at one end to the link 304 about axis 418 so that rotation of the link 304 rotates the spring fitting 312 about axis 420

A spring 314 is disposed between the biasing element 310 and the spring fitting 312. In the illustrated embodiment, the spring 314 is a compression spring positioned such that the rod 308 extends through the coils of the spring. The spring 314 engages the biasing element 310 and the spring fitting 312, which are configured such that the ends of the spring are restrained thereby. The spring 314 is sized and configured to have a preload that is reacted by the biasing element 310 and the spring fitting 312. The spring fitting 312 is rotatably coupled to mounting fitting 302 and, therefore, the spring force $F_S$ applied to the spring fitting by one end of the spring 314 is reacted out through the mounting fitting. The spring force $F_S$ applied to the biasing element 310 at the other end of the spring is reacted out through the rod 308 by virtue of its fixed connection to the biasing element. As a result, the spring force $F_S$ is applied to the link 304 through axis 418.

The spring force $F_S$ applied to the link 304 results in a moment $M_S$ about axis 416. The moment $M_S$ is reacted through roller bearing 306 into a lower surface of the first ramp panel 110. That is, the roller bearing 306 applies a counterbalance force $F_C$ to the first ramp panel 110. The counterbalance force $F_C$ is applied normal to the lower surface of the first ramp panel 110 and biases the first ramp panel and, therefore, the operable ramp 100 toward the deployed position.

It will be appreciated that the counterbalance 300 can be configured to provide a desired counterbalance force $F_C$ throughout the motion of the ramp. In this regard, the spring preload, spring constant k of the spring, the magnitude and variation of the moment arm throughout the travel of the operable ramp, as well as other factors can be modified to provide a desired performance curve. Further, multiple springs, various other types of springs, such as torsion springs, extension springs, non-linear springs, gas springs, etc., may be employed to provide a particular counterbalancing profile. These and other alternate configurations that provide a biasing force can be implemented and should be considered within the scope of the present disclosure.

Side Curb Assemblies

Figure 17:
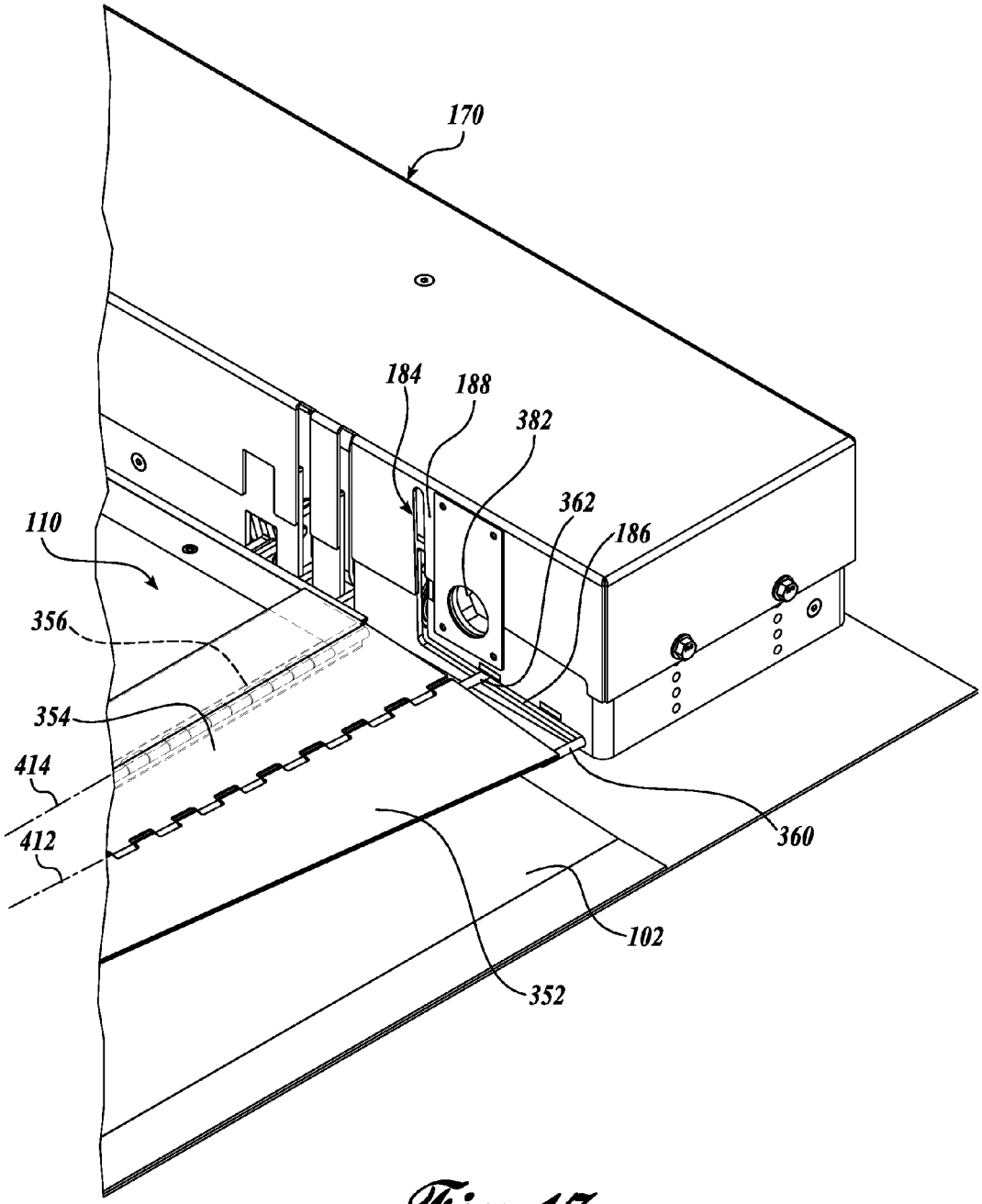
FIG. 17 shows a front partial isometric view of the operable ramp of FIG. 3.

As best shown in FIGS. 7 and 17, side curb assemblies 350 are positioned along the lateral edges 116 of the first ramp panel 110. When the operable ramp 100 is in the stowed position, the side curb assemblies 350 lie flat. As the operable ramp 100 moves to the deployed position, the side curb assemblies 350 move to a position in which the assemblies extend upward along the side edges of the first ramp panel 110 to prevent a user from accidentally dropping off of the side of the ramp. The side curb assemblies 350 also extend downward to act as a closeouts that blocks the area under the first ramp panel 110 when in the deployed position, thereby improving safety by minimizing the risk of a "pinch" type injury.

Each side curb assembly 350 includes a lower plate 352 hingedly coupled to an upper plate 354 about an axis 412. The upper plate 354 is hingedly coupled to a lateral edge 116 of the first ramp panel 110 about an axis 414 by a hinge 356. An outer pin 360 is positioned parallel to axis 412 and extends from an outer edge of the lower plate 352 into an L-shaped slot 184 formed in the housing 170. An inner pin 362 is positioned approximately along axis 412 and also extends into the slot 184.

When the operable ramp 100 is in the stowed position, the side curb assembly 350 lays essentially flat along the first ramp panel 110 and the base 102, with outer pin 360 and inner pin 362 extending into a lower horizontal portion 186 of the slot 184. As the operable ramp 100 moves to the deployed position, the first end 112 of the first ramp panel 110 moves upward, which also moves axis 414 upward. At the same time, the inner pin 362 moves along the slot 184 into a vertical portion 188 of the slot. As best shown in FIG. 7, the movement of axis 414 with the first ramp panel 110 and the movement of the inner pin 362 within the slot 184 raise the upper plate 354 and also rotates the upper plate about axis 414 such that a portion of the upper plate extends upward from axis 414 along the edge of the first ramp panel. A portion of the upper plate also extends downward from axis 414. As the upper plate 354 moves upwards and rotates, the lower plate 352, moves by virtue of its hinged connection to the upper plate and the engagement of the outer pin 360 with the horizontal leg 186 of the slot 184. In doing so, the lower plate 352 spans the distance from the lower edge of the upper plate 354 to the upper surface of the base 102.

Ramp Operation

When the operable ramp 100 is in the stowed position of FIGS. 1, 3, and 12, the operable ramp 100 integrates with the step 56 of the architectural environment. The upper surface 174 of the housing is generally coplanar with the tread 58 of the step 56, and the tread surface 126 of the first ramp panel 110 is essentially horizontal and parallel to the first surface 62 of the architectural environment. In the illustrated embodiment, the thickness of the operable ramp 100 at the first ramp panel 110 is approximately 1 inch, although other embodiments with greater or lesser thicknesses are possible. The second ramp panel 140 and the base 102, which extends outwardly from the lateral edges of the first ramp panel 100, both have inclined surfaces that provide a smooth transition from the tread surface 126 of the first ramp panel 110 to the first surface 62 of the architectural environment. Because of the thin profile of the first ramp panel 110 and the transitions provided by the base 102 and second ramp panel 140, it is not necessary to recess the operable ramp 100 below the first surface 62.

Referring now to FIGS. 12 and 13, with the operable ramp 100 in the stowed position (FIG. 12), the coupler 262 and, therefore, the ends of the support elements 128 extend beneath the lower sprocket 246 of the chain assembly 240 so that axis 410, and the first ramp panel 110 is substantially horizontal. To move the operable ramp 100 from the stowed position to the deployed position (FIG. 13), the motor 230 rotates the upper sprocket 242 in a first direction to drive the chain 260 in a first direction (clockwise as viewed in FIGS. 12 and 13) along the path of the endless loop, thereby raising the coupler 262 and, thus, the end of the support elements 128. As the coupler 262 moves along the arcuate portions 264, 266 and the linear portion 268 of the path of the endless loop, the vertical displacement raises the first end 112 of the first ramp portion 110. The second ramp panel 140 slides relative to the base 102 to account for the horizontal displacement of the coupler 262 along the arcuate portions 264 and 266 to prevent binding. The second ramp panel 140 also supports the second end 114 of the first ramp panel 110.

When the operable ramp 100 is in the deployed position, the coupler 262 is slightly over center of the upper sprocket 242. As a result, the support elements 128 extend above the upper sprocket 242 and engage cylindrical shoulders 244 that extend laterally from the upper sprocket. In this manner, the first ramp panel is supported by the upper sprocket 242, which prevents the operable ramp from dropping unexpectedly in the event of a power loss.

To move the operable ramp 100 from the deployed position to the stowed position, the motor 230 rotates the upper sprocket 242 in a second direction opposite the first direction (counter-clockwise as viewed in FIGS. 12 and 13), moving the chain 260 in a second direction along the path of the endless loop to lower the coupler 262. Lowering the coupler 262 lowers the ends of the support elements 128 and, therefore the first ramp panel 110.

It will be appreciated that a number of alternate drive assemblies 200 can be utilized to selectively drive the chain 260 in first and second directions along the endless loop. In one alternate embodiment, two motors are utilized, each motor driving one of the chain assemblies 240 to reciprocate the operable ramp between the stowed position and the deployed position. In another alternate embodiment, instead of the disclosed motor with a rotary output, a linear actuator is operably coupled to each support element 128 through a linkage. These and other configurations that selectively raise and lower the ends of the support elements 128 are contemplated and should be considered within the scope of the present disclosure.

Manual Stow/Deploy

As best shown in FIGS. 11 and 17, a gearbox 380 is operably coupled to one of the chain assemblies 240. The gearbox 380 includes an input shaft having a keyway 382, which is accessible through an access hole formed the housing 170. In the event of a loss of power or a motor failure, an operator can actuate the operable ramp 100 manually. To do so, the operator inserts a crank through the access hole onto the keyway 382 and rotates the crank in a first direction to move the operable ramp 100 toward the deployed position, and in a second direction to move the operable ramp toward the stowed position. It will be appreciated that a number of variations to the illustrated manual deploy and stow mechanism can be incorporated. In this respect, the size, position, and configurations of mechanisms that transfer a manual input into rotation of the chain assemblies 240 can vary, and such variations should be considered within the scope of the present disclosure.

While illustrative embodiments have been illustrated and described, it will be appreciated that various changes can be made therein without departing from the spirit and scope of the invention.

The invention claimed is:

1. An operable ramp moveable between a stowed position and a deployed position, the deployed position providing a sloped transition surface that extends from a lower surface of an architectural setting to an upper surface of the architectural setting, the operable ramp comprising:

(a) a housing disposed on the lower surface of the architectural setting, the housing having a selectively adjustable height;

(b) a first ramp panel comprising a support element extending from a first end of the first ramp panel; and (c) a drive assembly disposed within the housing, the drive assembly comprising an endless loop coupled to an end of the support element to reciprocate the operable ramp between the stowed position and the deployed position, the endless loop having a linear portion disposed between a first arcuate portion and a second arcuate portion, wherein the endless loop raises the end of the support element to move the first ramp panel from the stowed position to the deployed position, and wherein a distance between the first arcuate portion and the second arcuate portion is selectively adjustable.

2. The operable ramp of claim 1, the endless loop comprises a chain engaging a first sprocket and a second sprocket, wherein the first sprocket corresponds to the first arcuate portion and the second sprocket corresponds to the second arcuate portion.

3. The operable ramp of claim 2, wherein a distance between the first sprocket and the second sprocket is selectively adjustable.

4. The operable ramp of claim 3, wherein the first sprocket is positioned above the second sprocket.

5. The operable ramp of claim 3, further comprising a third sprocket engaging the chain, the third sprocket being selectively positionable to tension the chain when the distance between the first sprocket and the second sprocket changes.

6. The operable ramp of claim 3, wherein the support element extends over and is supported by the first sprocket when the operable ramp is in the deployed position.

7. The operable ramp of claim 3, further comprising a second ramp panel rotatably coupled to a second end of the first ramp panel, the first and second ramp panels cooperating to provide a sloped transition surface between the upper and lower surfaces of the architectural setting when the operable ramp is in the deployed position.

8. The operable ramp of claim 7, further comprising a base disposed below the first and second ramp panels, the second ramp panel being slidably coupled to the base.

9. The operable ramp of claim 8, wherein the second end of the first ramp panel is supported by the second ramp panel.

10. The operable ramp of claim 8, wherein the base extends laterally from the sides of the first ramp panel when the operable ramp is in the stowed position, the base providing inclined transition surfaces from a tread surface of the first ramp panel to the lower surface of the architectural setting.

11. The operable ramp of claim 3, further comprising a side curb assembly operably coupled to a lateral edge of the first ramp panel, the side curb assembly reciprocating between a raised position when the operable ramp is in the deployed position and a lowered position when the operable ramp is in the stowed position.

12. The operable ramp of claim 11, wherein the side curb assembly comprises:

(a) a side curb panel hingedly coupled to a lateral edge of the first ramp panel; and (b) a guide pin extending from the side curb panel, the pin extending into a slot formed in the housing, wherein movement of the first ramp panel translates the guide pin within the slot to cooperatively reciprocate the side curb assembly between the raised position and the stowed position.

13. An operable ramp moveable between a lowered stowed position and a raised deployed position, the operable ramp comprising:

(a) a base;

(b) a first ramp panel;

(c) a support element extending from a first end of the ramp panel, a second end of the first ramp panel being rotatable about an axis, the axis being slidingly associated with the base; and (d) a drive assembly comprising:

(i) an upper sprocket;

(ii) a lower sprocket; and (iii) a chain forming an endless loop that engages the upper sprocket and the lower sprocket, wherein the support element is rotatably coupled to the chain, movement of the chain in a first direction raising the support element, movement of the chain in a second direction lowering the support element, and wherein a distance between the upper sprocket and lower sprocket is selectively adjustable.

14. The operable ramp of claim 13, wherein the drive assembly is disposed within a housing, the housing having an upper surface, a distance between the upper surface and the base being selectively adjustable.

15. The operable ramp of claim 13, wherein the upper sprocket is mounted to a first support fitting, and the lower sprocket is mounted to a second support fitting coupled to the first support fitting, wherein the position of the first support fitting relative to the second support fitting is selectively adjustable.

16. The operable ramp of claim 13, wherein the first ramp panel is rotatably coupled to a second ramp panel about the axis, the second ramp panel being slidably coupled to the base.

17. The operable ramp of claim 16, wherein the base extends laterally from the sides of the first ramp panel when the operable ramp is in the stowed position, the base providing inclined transition surfaces from a tread surface of the first ramp panel to the lower surface of the architectural setting.

18. The operable ramp of claim 17, further comprising a side curb assembly operably coupled to a lateral edge of the first ramp panel, the side curb assembly reciprocating between a raised position when the operable ramp is in the deployed position and a lowered position when the operable ramp is in the stowed position.

19. The operable ramp of claim 18, wherein the side curb assembly comprises:

(a) a side curb panel hingedly coupled to a lateral edge of the first ramp panel; and (b) a guide pin extending from the side curb panel, the pin extending into a slot formed in the housing, wherein movement of the first ramp panel translates the guide pin within the slot to cooperatively reciprocate the side curb assembly between the raised position and the stowed position.

* * * * *